US006192717B1

(12) United States Patent
Rabinowicz

(10) Patent No.: US 6,192,717 B1
(45) Date of Patent: Feb. 27, 2001

(54) METHOD AND TUBULAR BLANK FOR MAKING SUBSTANTIALLY SEAMLESS GARMENTS

(75) Inventor: Sigi Rabinowicz, Beni-Brak (IL)

(73) Assignee: Alba-Waldensian, Inc., Valdese, NC (US)

( * ) Notice: Subject to any disclaimer, the term of this patent is extended or adjusted under 35 U.S.C. 154(b) by 0 days.

(21) Appl. No.: 09/590,003

(22) Filed: Jun. 8, 2000

(51) Int. Cl.[7] ..... D04B 1/24
(52) U.S. Cl. ..... 66/177; 66/171
(58) Field of Search ..... 66/176, 170, 169 R, 66/189, 174, 175, 177, 171, 198, 196

(56) References Cited

U.S. PATENT DOCUMENTS

| | | | | |
|---|---|---|---|---|
| 1,831,192 | * | 11/1931 | Persky | 66/171 |
| 1,868,854 | | 7/1932 | Smarr . | |
| 2,285,012 | * | 6/1942 | Burkey | 66/171 |
| 3,946,579 | | 3/1976 | Heinig . | |
| 4,010,627 | * | 3/1977 | Pernick | 66/177 |
| 4,043,156 | | 8/1977 | Pernick . | |
| 4,065,942 | | 1/1978 | Kejnovsky et al. . | |
| 4,259,973 | | 4/1981 | Gresillon . | |
| 4,527,403 | | 7/1985 | Fullbright et al. . | |
| 4,624,115 | | 11/1986 | Safrit et al. . | |
| 4,682,479 | | 7/1987 | Pernick . | |
| 4,920,769 | | 5/1990 | Rickerl . | |
| 5,031,424 | * | 7/1991 | Peleg et al. | 66/176 |
| 5,052,058 | | 10/1991 | Mueller . | |
| 5,081,854 | | 1/1992 | Lonati . | |
| 5,479,791 | | 1/1996 | Osborne . | |
| 5,553,468 | * | 9/1996 | Osborne | 66/171 |
| 5,572,888 | | 11/1996 | Browder, Jr. et al. . | |
| 5,605,060 | | 2/1997 | Osborne . | |
| 5,613,378 | | 3/1997 | Popa et al. . | |
| 5,746,068 | | 5/1998 | Popa et al. . | |
| 5,836,179 | | 11/1998 | van Laar . | |
| 5,946,944 | | 9/1999 | Osborne . | |

FOREIGN PATENT DOCUMENTS 2 076 634 12/1981 (GB) .

* cited by examiner

*Primary Examiner*—Danny Worrell
(74) *Attorney, Agent, or Firm*—Alston & Bird LLP

(57) ABSTRACT

Multiple garments such as panties, briefs, bodysuits, teddys, and brassieres are produced from a single circularly knit fabric tube. Multiple garments of differing silhouettes can be produced from the same tube. The garment includes a tubular portion for encircling the torso of a wearer, and at least one non-tubular portion for forming a crotch or gusset and/or one or two shoulder straps. The non-tubular portions of two adjacent garments are cut from the same lengthwise-extending portion of the tube. The tube in one embodiment has at least one gusset panel formed therein at one longitudinal location along the tube when two garments are to be produced from the tube, and at a plurality of longitudinal locations along the tube when more than two garments are to be produced from the tube. The gusset panel has a different knit construction from the rest of the tube. The tube is cut along silhouette sew lines to define front and rear panels and a gusset for each garment, the gussets for two adjacent garments being cut from the at least one gusset panel at one of the longitudinal locations of the tube. The tube in another embodiment is cut along sew lines to define shoulder straps.

33 Claims, 3 Drawing Sheets

METHOD AND TUBULAR BLANK FOR MAKING SUBSTANTIALLY SEAMLESS GARMENTS

FIELD OF THE INVENTION

The invention relates to substantially seamless garments such as panties, briefs, bodysuits, brassieres, and the like. The invention relates more particularly to methods for making such garments from circularly knit tubular fabric blanks, and to tubular blanks from which such garments are made.

BACKGROUND OF THE INVENTION

It is known to form a lower-body garment such as a panty from a circularly knit tubular blank by cutting away one or more regions of the blank to form portions that can subsequently be joined together in the crotch area to make leg openings, as shown for example in U.S. Pat. No. 4,624,115. Such a panty is desirable from an aesthetic standpoint because it does not have any seams in the torso-encircling part of the panty that might be unsightly under a wearer's clothes, and is advantageous from a manufacturing standpoint because only a minimal amount of sewing need be performed to form the finished panty.

It is also known to form a bodysuit from a seamless knit tubular blank by cutting away regions of the blank to define leg openings and a crotch portion that can subsequently be joined to the rear panel of the bodysuit, and wherein the crotch portion has a modified knit construction such as a construction having a terry pile surface on the side facing the wearer, as shown in commonly owned U.S. Pat. No. 5,605,060, the disclosure of which is incorporated herein by reference. In the '060 patent, a tubular blank is used for fashioning a single bodysuit. The present invention represents a further development of the technology exemplified in the '060 patent as applied to the manufacture of garments such as panties, briefs, bodysuits, brassieres, or the like, enabling a more-efficient usage of material.

SUMMARY OF THE INVENTION

The invention provides methods for making garments from seamless knit tubular blanks, and tubular blanks for making such garments, enabling multiple garments such as panties, briefs, bodysuits, teddys, and brassieres to be produced from a single circularly knit fabric tube. Multiple garments of differing silhouettes can be produced from the same tube. Each garment generally includes a tubular portion for encircling the torso of a wearer, and at least one non-tubular portion for forming a crotch or gusset and/or one or two shoulder straps. The non-tubular portions of two adjacent garments preferably are cut from the same lengthwise-extending portion of the tube at circumferentially staggered locations about the tube.

The tube in one embodiment has at least one gusset panel formed therein at one longitudinal location along the tube when two garments are to be produced from the tube, and at a plurality of longitudinal locations along the tube when more than two garments are to be produced from the tube. The gusset panel has a different knit construction from the rest of the tube. The tube is cut along silhouette sew lines to define front and rear panels and a gusset for each garment, the gussets for two adjacent garments being cut from the at least one gusset panel at one of the longitudinal locations of the tube.

In one embodiment of the invention, a seamless fabric tube is formed with a circumference suitable to accommodate the lower torso of a wearer therein and having a length about twice a lengthwise dimension of garments to be produced so that two garments can be produced from the tube. At least one gusset panel is knit into the tube at a longitudinally central region of the tube, the panel having a knit construction differing from that of the remainder of the tube. For example, the gusset panel may be knit with a terry pile surface on the side that faces the wearer in use. The fabric tube is then cut along silhouette sew lines (i.e., the lines that will define the leg openings of the garments) so as to divide the tube into two garment blanks each having a front panel and a rear panel and a gusset portion integrally knit with one of the front and rear panels. The silhouette sew lines are so arranged such that the opposite ends of the tube form the waist-encircling portions of the blanks, and the gusset portion of each blank is cut from the at least one gusset panel. Thus, the garments are formed from the fabric tube in opposite top-to-bottom orientation relative to each other. To form the finished garments, the gusset portion of each blank is joined to the other of the front and rear panels of the blank. Decorative and/or elastic banding may be sewn along the leg openings, and preferably is simultaneously sewn as the fabric tube is being cut along the silhouette sew lines. In a preferred embodiment of the invention, an aperture (e.g., a slit or hole) is formed in the fabric tube as the tube is being knit, the aperture enabling a portion of an automatic sewing machine to be inserted for starting the cutting of the tube along the silhouette sew line.

In one advantageous embodiment of the invention, the silhouette sew lines of the two blanks are circumferentially staggered relative to each other such that each of the gusset portions is formed from substantially the full axial length of the at least one gusset panel. The gusset panel can comprise a full-circumferential panel or, alternatively, two separate gusset panels that are circumferentially spaced apart from each other can be formed in the fabric tube, preferably occupying the same axial portion of the tube such that the gusset panels overlap in the axial direction.

The two-garment fabric tube, when used for making panties or brassieres or the like, preferably has turned welts formed at its opposite ends for forming torso-encircling bands of the two garments. The turned welts can incorporate elastic yarns for forming elasticized bands.

The method of the invention can also be used for making brassieres in which the non-tubular portions of the garment blanks form shoulder straps, or for making bodysuits or the like in which non-tubular portions are provided on both ends of each garment blank for forming both crotch portions and shoulder straps. In each case, the non-tubular portions preferably are circumferentially staggered from one blank to the adjacent blank along the fabric tube such that they are cut from the same lengthwise-extending portion of the tube.

In another aspect of the invention, more than two garments can be formed from a single fabric tube. When the garments have crotch portions, the fabric tube has at least one gusset panel of different knit construction formed at each of a plurality of locations longitudinally spaced along the length of the tube. The at least one gusset panel preferably has an axial length that does not substantially exceed the length of the gusset of a garment to be produced from the tube. The at least one gusset panel can comprise a pair of separate gusset panels that are circumferentially spaced from each other. The tube is cut along silhouette sew lines arranged such that adjacent pairs of garment blanks are alternately oriented top-to-top and bottom-to-bottom along the tube, and the bottom-to-bottom garment blanks have their silhouette sew lines circumferentially staggered relative to each other such that their gussets are axially overlapping and circumferentially spaced from each other.

Preferably, at least first, second, third, and fourth blanks are produced from the tube, arranged sequentially thereal-ong. The first and third blanks have the same top-to-bottom orientation, and the second and fourth blanks have the same top-to-bottom orientation that is opposite that of the first and third blanks. Preferably, the first and third blanks have the same circumferential orientation, and the second and fourth blanks have the same circumferential orientation that is circumferentially staggered relative to that of the first and third blanks.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
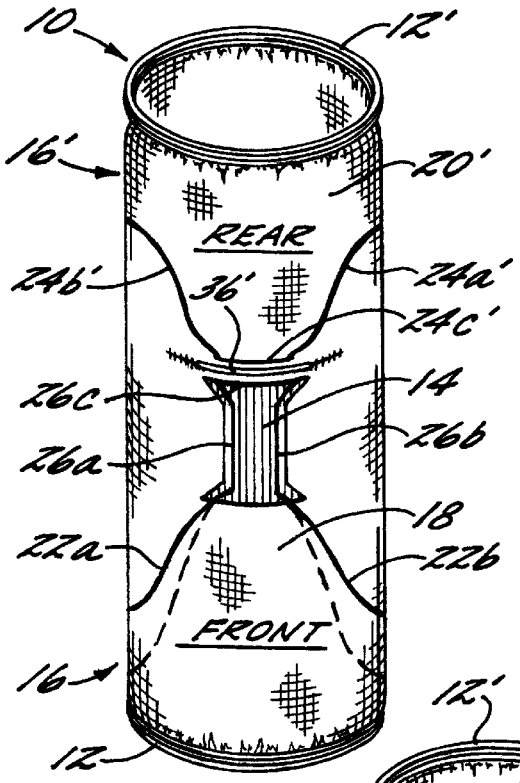
FIG. 1 is a front perspective view of a two-garment fabric tube in accordance with one preferred embodiment of the invention.
Figure 2:
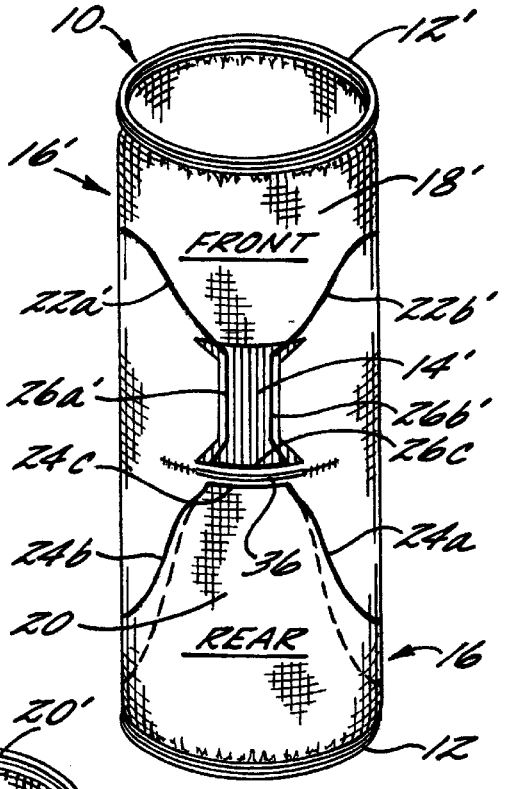
FIG. 2 is a rear perspective view of the two-garment fabric tube of FIG. 1.

FIGS. 1 through 6 depict embodiments of the invention as applied to the manufacture of panties or similar types of lower-body undergarments. With reference to FIGS. 1 through 4, a first preferred embodiment of the invention is now described. FIGS. 1 and 2 depict a two-garment fabric tube 10 viewed from the front and the rear, respectively. The tube 10 is a circularly knit tube sized in circumference to accommodate the lower torso of a wearer therein. As will be recognized, the tube 10 can be made in any of a number of different circumferences corresponding to different waist sizes of the persons anticipated to be wearing the garments to be produced. Accordingly, the circumference of the tube 10 can have a broad range for fitting children or adults of various proportions.

The tube 10 preferably has non-raveling edges 12 and 12' formed at the opposite ends of the tube. Preferably, the non-raveling edges 12, 12' are formed as turned welts during the circular knitting of the tube, and the turned welts can serve as the waistbands for each of two garments to be produced from the tube. The fabric in the region of the turned welts 12, 12' can have elastic yarns incorporated into the fabric, such as by knitting the elastic yarns or by laying in the elastic yarns in front and in back of spaced stitches, so as to provide elasticity to the waistbands. The formation of such turned welts on circular knitting machines, in and of itself, is known in the art, as exemplified for instance in U.S. Pat. No. 4,043,156, incorporated herein by reference, and hence is not further described herein.

The tube 10 also includes a pair of gusset panels 14 and 14'. The gusset panel 14 will be used for forming the crotch or gusset of one of the garments to be produced, and the gusset panel 14' will be used for forming the crotch or gusset of the other garment. The gusset panels 14, 14' have a different knit construction from that of the rest of the tube 10 so as to impart a desired quality, such as absorbency, breathability, etc., to the gusset. By "different knit construction" is meant a different configuration of the stitch loops and/or a different denier and/or type of yams from that of the rest of the tube. As but one illustrative example, the gusset panels 14, 14' can be formed with a mock rib construction having a terry surface on their inwardly facing sides. Additionally or alternatively, the gusset panels 14, 14' can be knit of different yam types from the rest of the tube. For example, the tube can be formed of a synthetic yarn while the gusset panels are formed from yarns made of natural fibers such as cotton or the like. It is also within the scope of the invention to incorporate a different yam type, such as cotton yarn, only on the inwardly facing side of the gusset panels 14, 14', while the outwardly facing side of the panels are formed of the same yarn type as the rest of the fabric tube. The gusset panels can also incorporate elastic yams, if desired.

Figure 3:
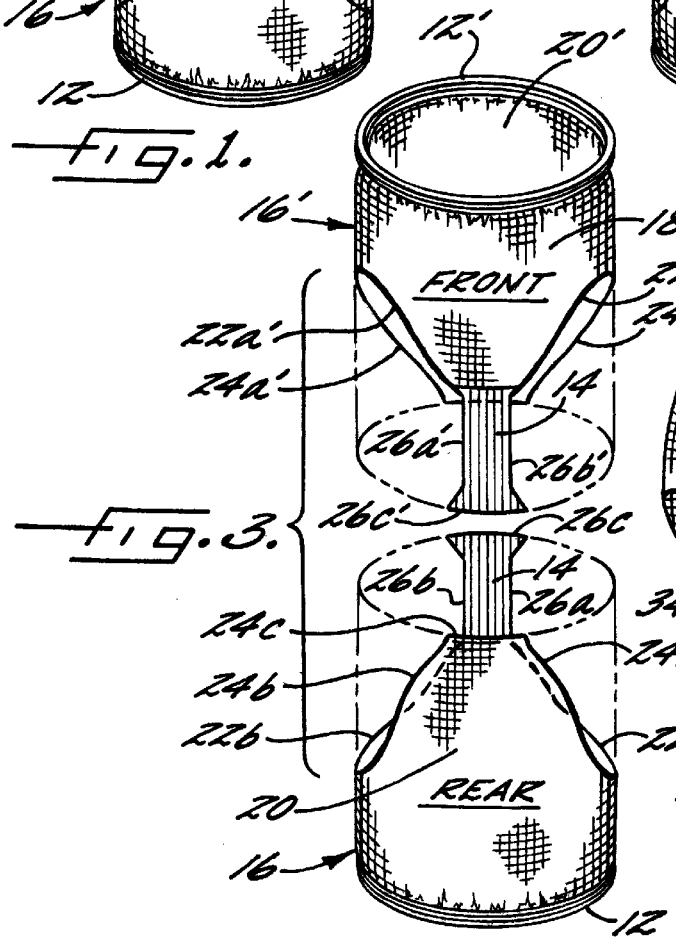
FIG. 3 is a view similar to FIG. 2, showing the fabric tube having been cut along silhouette sew lines so as to divide the tube into two garment blanks.

In the embodiment of the invention shown in FIGS. 1–3, each gusset panel 14, 14' is formed to have an axial length, a width, and a shape substantially matching that of the gusset portion of the garment to be produced, although the length and width of the panels can be slightly greater than the finished gusset if desired. The two gusset panels 14 and 14' are axially overlapping and are circumferentially spaced 180° apart. It is not essential that the gusset panels be on diametrically opposite sides of the tube 10, although this arrangement may facilitate subsequent cutting of the tube to make the garments. The knit construction of the tube 10 in the intervening spaces between the gusset panels 14, 14' is the same as the rest of the tube.

In order to form two lower-body garments from the tube 10, the tube is cut along silhouette sew lines so as to define front and rear panels for each of the garments and so as to separate the two garments from each other. In FIGS. 1 and 2, two garment blanks 16 and 16' are shown prior to being cut from the fabric tube 10, and FIG. 3 shows the two blanks after having been cut out from the tube. Each garment blank 16, 16' has a front panel 18, 18' and a rear panel 20, 20'. The front and rear panels of each blank are integrally joined at their upper edges to the respective turned welt 12, 12'. In the illustrated embodiment, the gusset panels 14, 14' are integrally knit to the lower edges of the front panels 18, 18'; however, alternatively the gusset panels could be integrally knit to the lower edges of the rear panels. The terms "upper" and "lower" as used in connection with the garment blank refer to the orientation of the finished garment when worn by a person in a standing position.

For the blank 16, to define the opposite side edges of the front panel 18 the fabric tube 10 is cut along silhouette sew lines 22*a* and 22*b*, and to define the opposite side edges of the rear panel 20 the tube is cut along silhouette sew lines 24*a* and 24*b*. The tube is also cut along a transverse sew line 24*c* to define a lower edge of the rear panel. To define the opposite side edges of the gusset, the tube is cut along sew lines 26*a*, 26*b*; the tube is also cut along a transverse sew line 26*c* to define a lower edge of the gusset. As best seen in FIG. 3, the silhouette sew line 22*a* and the silhouette sew line 24*a* join each other at their upper ends on one side of the blank and the sew line 22*a* at its lower end joins the gusset sew line 26*a*; likewise, the sew line 22*b* and the sew line 24*b* join each other at their upper ends on the opposite side of the blank and the sew line 22*b* at its lower end joins the gusset sew line 26*b*. The other blank 16' is similarly formed by cutting along silhouette sew lines 22*a*', 22*b*', 24*a*', 24*b*', 24*c*', 26*a*', 26*b*', and 26*c*'. A feature of the invention is that the silhouette sew lines for the blank 16' can be of different contour from those of the other blank 16, as indicated in dashed lines in FIGS. 1 and 2. In this manner, garments of two different styles can be formed from the same fabric tube. For example, a bikini brief and a high-leg brief can be formed from the same tube.

Figure 4:
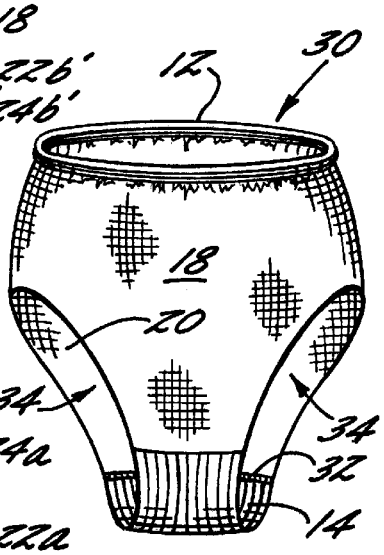
FIG. 4 is a perspective view of a finished garment produced in accordance with the invention.

As shown in FIG. 4, a finished garment 30 is formed from the blank 16 by sewing the lower edge 24*c* of the rear panel 20 to the lower edge 26*c* of the gusset 14 along a sew line 32, thereby defining two leg openings 34. Thus, the garment 30 is substantially seamless, and in particular does not have any side seams for joining the front panel to the rear panel. The edges of the leg openings 34 can have elastic banding (not shown) sewn thereto, if desired. Advantageously, the cutting of the blank from the fabric tube along the silhouette sew lines 22*a*, 22*b*, 24*a*, 24*b*, 26*a*, 26*b*, and the sewing of the elastic banding along the resulting edges of the blank, can be performed simultaneously on a sewing machine that cuts the fabric and sews the banding in one operation. To facilitate this operation, the fabric tube 10 preferably includes a pair of knit-in slits or apertures 36, 36' that are formed on the circular knitting machine during the knitting of the tube. The apertures 36, 36' are formed adjacent at least one of the silhouette sew lines of each blank; in the illustrated embodiment the apertures are formed adjacent the lower edges 26*c*, 26*c*' of the gusset panels. The sewing machine operator can slip one part of the fabric tube adjacent one of the apertures beneath the pressure plate of the sewing machine and start cutting the tube along one of the silhouette sew lines. For example, for the blank 16 the operator can start at the aperture 36 and cut and apply banding along the gusset side sew line 26*a*, along the front panel side sew line 22*a*, and along the rear panel side sew line 24*a*. The operation can be repeated for the other side of the blank along the sew lines 26*b*, 22*b*, and 24*b*. The fabric tube 10 can then be cut along the transverse cut lines 24*c* and 26*c* to completely separate the blank 16 from the tube.

To aid the sewing machine operator in cutting along the desired silhouette sew lines, the fabric tube 10 can include visible indicators for the locations of the sew lines. The visible indicators can be provided in various ways. For instance, visibly different stitch loops can be formed in the location of the silhouette sew lines during the circular knitting of the tube. The lines in FIGS. 1 and 2 indicated by the reference numerals 22*a*, 22*b*, 24*a*, 24*b*, 24*c*, 26*a*, 26*b*, and 26*c* for the blank 16 are intended to represent such visible indicators, and likewise for the corresponding lines of the blank 16'.

Figure 5:
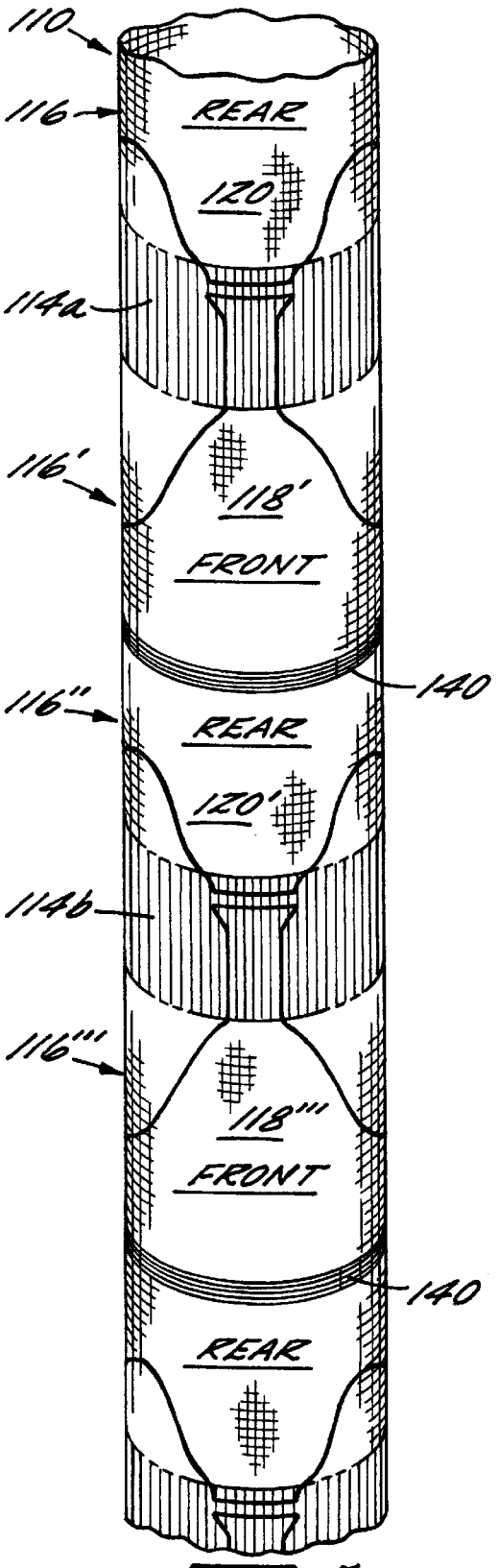
FIG. 5 is a front perspective view of a multi-garment fabric tube in accordance with another preferred embodiment of the invention.
Figure 6:
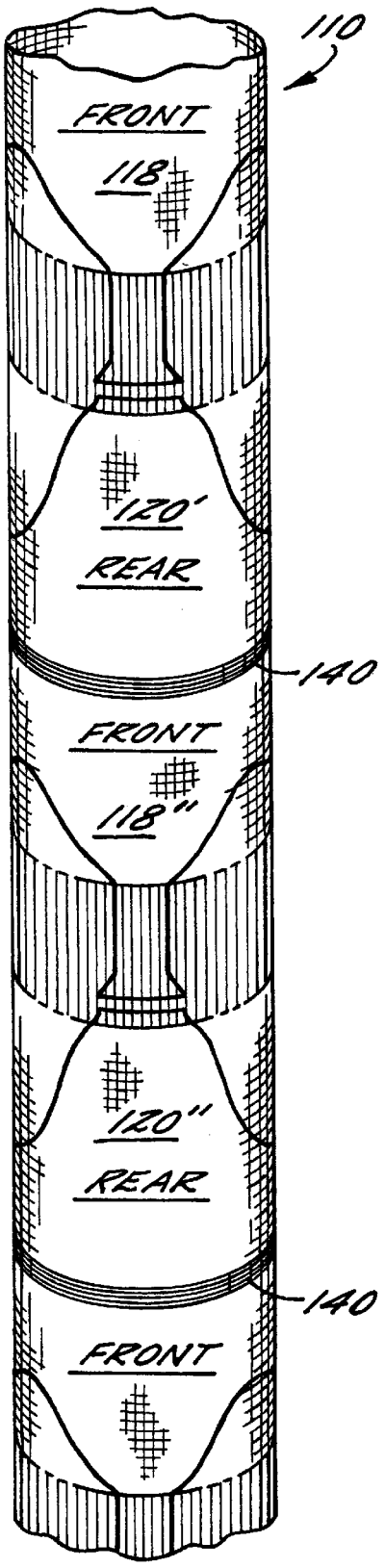
FIG. 6 is a rear perspective view of the fabric tube of FIG. 5.

In another aspect of the invention, more than two panties or the like can be made from a single fabric tube. FIGS. 5 and 6 illustrate a fabric tube 110 in front and rear perspective view, respectively. The tube 110 defines a multiplicity of garment blanks 116, 116', 116", 116'", etc. For purposes of explanation, the arrangement of four of the blanks 116, 116', 116", and 116'" will be described. However, it should be understood that the invention is not limited to four blanks per tube, but could be used for making fewer or more than four garments from a single tube. Unlike the tube 10 previously described, the tube 110 does not include turned welts for forming waistbands of the garments. The tube 110 includes at least one gusset panel 114*a*, 114*b* at each of a plurality of locations spaced longitudinally apart along the length of the tube. The locations of the gusset panels are spaced apart by about twice an axial dimension of a garment blank to be cut from the tube. In the illustrated embodiment of FIGS. 5 and 6, there is a single gusset panel 114*a*, 114*b* formed at each longitudinal location along the tube. Each gusset panel 114*a*, 114*b* extends about the full circumference of the fabric tube and has an axial length at least as great as, and preferably not substantially exceeding, the length of a gusset of a garment blank to be produced. The gussets of two adjacent garment blanks are cut from a single gusset panel. Thus, the gussets for the blanks 116 and 116' are cut from the gusset panel 114*a*, and the gussets for the blanks 116" and 116'" are cut from the gusset panel 114*b*. The top-to-bottom orientation of the blanks alternates along the length of the tube. Thus, the first and third blanks 116 and 116' are oriented with the same top-to-bottom orientation, and the second and fourth blanks 116' and 116'" are oriented with the same top-to-bottom orientation that is opposite to that of the first and third blanks.

When cutting the blanks from the tube 110 along silhouette sew lines, the circumferential orientations of the blanks on opposite sides of each gusset panel 114*a* and 114*b* are different; that is, the two gussets cut from the gusset panel 114*a* are circumferentially staggered, and likewise for the two gussets cut from the gusset panel 114*b*. In the illustrated embodiment, the first and second blanks 116 and 116' that share the common gusset panel 114*a* are oriented 180° apart, similar to the two-panty tube 10 previously described. Likewise, the third and fourth blanks 116" and 116'" that share the gusset panel 114*b* are oriented 180° apart from each other and are circumferentially oriented the same as the blanks 116 and 116'. Thus, the blanks are arranged along the tube in pairs that repeat along the tube. By arranging the silhouette sew lines in this manner, the fabric tube 110 can be flattened such that the front panels 118, 118', 118", 118'" overlie the rear panels 120, 120', 120", 120'" with the silhouette sew lines of the overlying panels generally aligned, and the sew lines for both the front and rear panels can be cut simultaneously. Adjacent blanks that are arranged top-to-top (e.g., blanks 116' and 116") can then be separated by cutting along a full-circumferential line at the desired location of the top edge of each blank, and adjacent blanks that are arranged bottom-to-bottom (e.g., blanks 116 and 116') can be separated by cutting along a line between the lower edge of the rear panel of each blank and the lower edge of the gusset of the adjoining blank. The blanks are then finished by sewing the gusset to the rear panel, and sewing an elasticized waistband onto the blank. Elastic banding can also be sewn around the leg openings.

As an alternative to sewing a separate elasticized waistband onto each garment, the fabric tube can have elasticized band-shaped regions 140 knit into the tube, such as by knitting or laying in elastic threads during the circular knitting process for a plurality of courses. Each of the elasticized band-shaped regions is divided in two to separate the blanks and form an elasticized waistband portion for each blank. The elasticized waistband portion can be turned inward and sewn to form a two-ply waistband.

The fabric tube 110 illustrated in FIGS. 5 and 6 has a full-circumferential gusset panel 114*a*, 114*b* at each longitudinal location along the tube, the entire gusset panel having a knit construction differing from that of the rest of the tube. However, it will be recognized that the fabric tube 110 can instead have two separate gusset panels at each longitudinal location along the tube, similar to the two-panty tube 10 of FIGS. 1–3. Conversely, the two-panty tube 10 can have a single full-circumferential gusset panel similar to that of the tube 110.

It can thus be seen that the invention enables garments such as panties or the like to be produced with a minimal amount of sewing required, and the resulting garments are substantially seamless with the exception of one seam in the crotch.

It should also be apparent that the method of the invention is not limited to the manufacture of lower-body undergarments such as panties, but can also be used for other types of garments such as bodysuits, teddys, brassieres, and the like. In each case, the garment will include a tubular portion that encircles the torso of the wearer, and one or more non-tubular portions for forming a crotch portion and/or one or two shoulder straps. The non-tubular portions preferably are circumferentially staggered from one blank to an adjacent blank along the fabric tube such that they are cut from the same lengthwise-extending portion of the tube.

Figure 7:
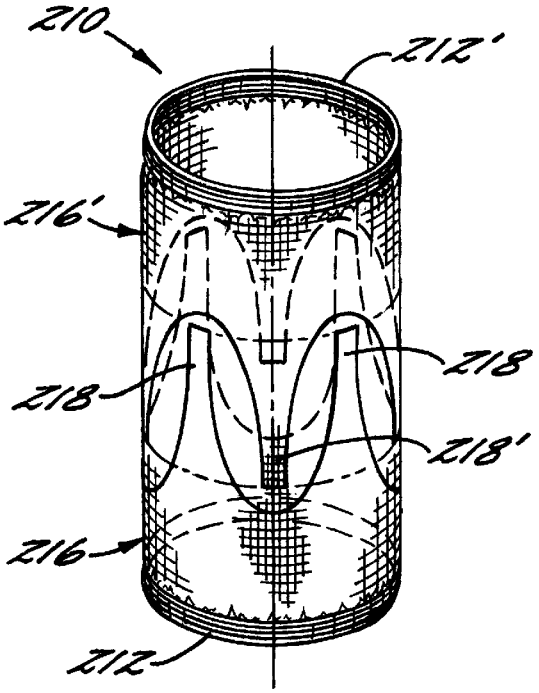
FIG. 7 is a front perspective view of a fabric tube for forming two brassieres in accordance with still another preferred embodiment of the invention.
Figure 8:
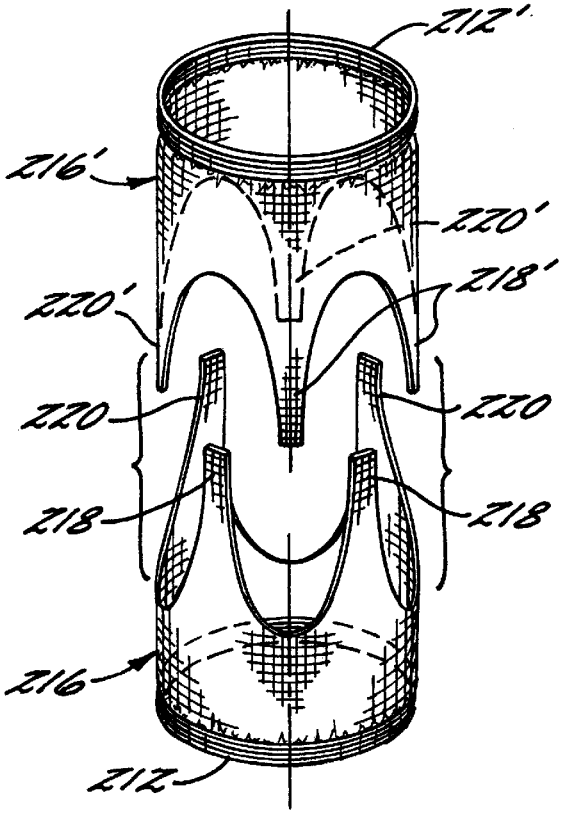
FIG. 8 is a perspective view of the fabric tube of FIG. 7 after having been cut along silhouette sew lines to divide the tube into two garment blanks.

Thus, FIGS. 7 and 8 depict an embodiment of the invention for making brassieres. A fabric tube 210 is knit, and preferably has a turned welt 212 formed at one end and another turned welt 212' formed at the other end of the tube. To make two brassieres from the tube 210, the tube is cut along silhouette sew lines to define two blanks 216 and 216' each having two front shoulder strap portions 218, 218' and two rear shoulder strap portions 220, 220' that are subsequently joined together by sewing to form two shoulder straps. The shoulder strap portions 218, 220 of the blank 216 are circumferentially staggered relative to those of the other blank 216' such that they are cut from the same lengthwise-extending portion of the tube 210.

It will be recognized that bodysuits, teddys, or the like, having both a crotch and shoulder straps can be made in accordance with the present invention by circumferentially staggering the silhouette sew lines of one blank relative to adjacent blanks such that the non-tubular portions that form the crotch of one blank and that of the adjacent blank are cut from the same lengthwise-extending portion of the fabric tube, and likewise for the non-tubular portions that form the shoulder straps of adjacent blanks.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for making a pair of garments, comprising:

circularly knitting a fabric tube sized in circumference to accommodate a wearer's torso therein;

knitting at least one gusset panel into a longitudinally central portion of the tube, the central portion of the tube being continuously knit about a full circumference thereof, the at least one gusset panel comprising at least part of the circumference of the central portion and having a knit construction differing from that of the remainder of the tube outside the central portion thereof;

cutting the fabric tube along silhouette sew lines so as to divide the tube into two garment blanks each having a front panel and a rear panel and a gusset portion integrally knit with one of the front and rear panels, the opposite ends of the tube forming waist-encircling portions of the blanks and the gusset portion of each blank being cut from the at least one gusset panel; and joining the gusset portion of each blank to the other of the front and rear panels of the blank, so as to form two garments from the fabric tube.

2. The method of claim 1, wherein knitting the at least one gusset panel comprises knitting a single panel that extends continuously about the full circumference of the fabric tube, and wherein the silhouette sew lines of the two blanks are circumferentially staggered relative to each other such that each of the gusset portions is formed from substantially a full axial length of the panel.

3. The method of claim 1, wherein knitting the at least one gusset panel comprises knitting a pair of gusset panels each extending only partially about the circumference of the fabric tube and each having a knit construction differing from that of the remainder of the fabric tube outside the central portion thereof, and wherein the gusset portion for each blank is formed from one of the gusset panels.

4. The method of claim 3, wherein the gusset panels are formed so as to be circumferentially staggered relative to each other and to overlap each other in the longitudinal direction of the fabric tube.

5. The method of claim 1, further comprising forming a non-raveling edge at each end of the tube.

6. The method of claim 1, further comprising forming a turned welt at each end of the tube for forming waistbands of the two garments.

7. The method of claim 1, wherein the silhouette sew lines for one of the blanks are formed to be of different contour from the silhouette sew lines for the other blank.

8. The method of claim 1, wherein the tube is formed to have a visible feature indicating the location of each silhouette sew line along which the tube is to be cut.

9. The method of claim 8, wherein the visible feature is knit into the tube.

10. The method of claim 1, further comprising knitting an aperture into a side wall of the fabric tube during the circular knitting thereof, the aperture being located proximate the silhouette sew line along which the tube subsequently will be cut so as to serve as a starting point for the cutting operation.

11. A tubular blank for forming a pair of lower-body garments therefrom, the blank comprising:

a circular-knit fabric tube sized in circumference to accommodate a wearer's lower torso therein;

a non-raveling edge formed at each end of the fabric tube for forming a waistband portion of each of the two garments; and at least one gusset panel knit into the tube at a longitudinally central portion thereof and having an axial length sufficient to form gussets for the garments therefrom, the central portion of the tube being continuously knit about a full circumference thereof, and the at least one gusset panel comprising at least part of the circumference of the central portion and having a knit construction differing from that of the remainder of the blank outside the central portion thereof.

12. The tubular blank of claim 11, wherein the non-raveling edges comprise turned welts.

13. The tubular blank of claim 11, wherein the axial length of the at least one gusset panel is substantially equal to a lengthwise dimension of the gusset of the garments.

14. The tubular blank of claim 11, further comprising an aperture knit into a side wall of the fabric tube during the circular knitting thereof, the aperture serving as a starting point enabling a portion of a cutting device to be inserted therethrough to begin cutting the blank for forming the garments.

15. The tubular blank of claim 11, wherein the at least one gusset panel is formed with a terry pile surface.

16. The tubular blank of claim 11, wherein the at least one gusset panel comprises a single panel extending about the full circumference of the fabric tube.

17. The tubular blank of claim 11, wherein the at least one gusset panel comprises a pair of gusset panels each extending only partially about the circumference of the fabric tube and being circumferentially spaced apart from each other.

18. The tubular blank of claim 11, wherein the non-raveling edges comprise turned welts knit into the fabric tube during the circular knitting thereof.

19. A method for making garments, comprising:

circularly knitting a fabric tube sized in circumference to accommodate a wearer's torso therein;

knitting at least one gusset panel into the tube at each of a plurality of tubular portions of the tube spaced longitudinally along the tube, each of said tubular portions being continuously knit about a full circumference thereof the at least one gusset panel at each said tubular portion comprising at least part of the circumference of the tubular portion and having a predetermined axial length and a knit construction differing from that of the remainder of the tube outside said tubular portions;

cutting the fabric tube along silhouette sew lines so as to divide the tube into a plurality of garment blanks each having a front panel and a rear panel and a gusset portion integrally knit with one of the front and rear panels, the gusset portion of each blank being cut from one of the gusset panels; and joining the gusset portion of each blank to the other of the front and rear panels of the blank so as to form a plurality of garments from the fabric tube.

20. The method of claim 19, wherein the fabric tube is cut to form at least first, second, third, and fourth blanks sequentially arranged along the length of the fabric tube.

21. The method of claim 20, wherein the first and third blanks have the same top-to-bottom orientation, and the second and fourth blanks have the same top-to-bottom orientation that is opposite from that of the first and third blanks.

22. The method of claim 21, wherein knitting the at least one gusset panel at each said tubular portion along the fabric tube comprises knitting a single panel extending about the full circumference of the fabric tube, and wherein the fabric tube is cut such that silhouette sew lines for the blanks adjacent to and on opposite sides of each panel are circumferentially staggered relative to each other.

23. The method of claim 21, wherein the fabric tube is cut such that the first and third blanks have the same circumferential orientation, and the second and fourth blanks have the same circumferential orientation that is circumferentially staggered relative to that of the first and third blanks.

24. The method of claim 23, wherein the fabric tube is cut such that the first and third blanks are circumferentially staggered about 180° relative to the second and fourth blanks.

25. The method of claim 21, wherein knitting the at least one gusset panel at each said tubular portion along the tube comprises knitting a pair of circumferentially spaced panels each having a different knit construction from that of the remainder of the fabric tube outside the tubular portions.

26. The method of claim 21, wherein the fabric tube is knit so as to incorporate elastic threads in a band-shaped portion of the tube at each of a plurality of locations about midway between each adjacent pair of gusset panels, each band-shaped portion being divided in two and used for forming elastic waistbands of two garments.

27. A tubular blank for making a plurality of garments therefrom, the blank comprising:

a circular-knit fabric tube sized in circumference to accommodate a wearer's torso therein; and at least one gusset panel knit into the fabric tube at each of a plurality of tubular portions of the tube spaced longitudinally along the tube, each of said tubular portions being continuously knit about a full circumference thereof, the gusset panels each comprising at least part of the circumference of the tubular portion and having a knit construction differing from that of the remainder of the fabric tube outside the tubular portions.

28. The tubular blank of claim 27, wherein the at least one gusset panel at each said tubular portion comprises a single full-circumference panel.

29. The tubular blank of claim 27, wherein the at least one gusset panel at each said tubular portion comprises a pair of circumferentially spaced gusset panels.

30. The tubular blank of claim 29, wherein the two gusset panels at each said tubular portion are spaced about 180° from each other and overlap in the longitudinal direction of the tube.

31. The tubular blank of claim 27, further comprising a plurality of elasticized band-shaped portions knit into the blank at a plurality of locations each located about midway between each pair of adjacent gusset panels.

32. A method for forming a plurality of substantially seamless garments each of which has a seamless tubular portion for encircling the torso of a wearer and at least one non-tubular fabric portion joined to the tubular portion for forming at least a shoulder strap, the method comprising:

knitting a fabric tube having a circumference for accommodating the torso of a wearer therein;

cutting the fabric tube along silhouette sew lines so as to divide the fabric tube into a plurality of garment blanks and such that the at least one non-tubular fabric portion of one blank and the at least one non-tubular fabric portion of an adjacent blank are cut from the same lengthwise-extending portion of the fabric tube; and attaching an end of the at least one non-tubular portion of each blank to another portion of the blank to form at least one shoulder strap on each garment.

33. The method of claim 32, wherein two garments are produced from the fabric tube, an elasticized turned welt being formed at each end of the fabric tube for forming a torso-encircling band at a lower end of each garment.

* * * * *